US009466878B2

(12) United States Patent
Wei et al.

(10) Patent No.: US 9,466,878 B2
(45) Date of Patent: Oct. 11, 2016

(54) MULTI-BAND ANTENNA

(71) Applicant: HON HAI PRECISION INDUSTRY CO., LTD., New Taipei (TW)

(72) Inventors: Cheng-Fan Wei, New Taipei (TW); Lung-Sheng Tai, New Taipei (TW); Wen-Fong Su, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 299 days.

(21) Appl. No.: 13/964,127

(22) Filed: Aug. 12, 2013

(65) Prior Publication Data

US 2014/0043200 A1 Feb. 13, 2014

(30) Foreign Application Priority Data

Aug. 10, 2012 (TW) ..... 101128889 A

(51) Int. Cl.

| | |
|---|---|
| ***H01Q 1/48*** | (2006.01) |
| ***H01Q 5/364*** | (2015.01) |
| ***H01Q 9/04*** | (2006.01) |
| ***H01Q 1/24*** | (2006.01) |
| ***H01Q 5/378*** | (2015.01) |

(52) U.S. Cl.

CPC ..... *H01Q 1/48* (2013.01); *H01Q 1/243* (2013.01); *H01Q 5/364* (2015.01); *H01Q 5/378* (2015.01); *H01Q 9/0421* (2013.01)

(58) Field of Classification Search

CPC ..... H01Q 1/48

See application file for complete search history.

(56) References Cited

U.S. PATENT DOCUMENTS

| | | | | |
|---|---|---|---|---|
| 7,911,390 | B2 * | 3/2011 | Chiu | 343/700 MS |
| 8,390,517 | B2 * | 3/2013 | Chiang et al. | 343/700 MS |
| 2007/0030203 | A1 * | 2/2007 | Tsai et al. | 343/702 |
| 2010/0097282 | A1 | 4/2010 | Chirila | |
| 2010/0127941 | A1 * | 5/2010 | Chiang | H01Q 1/243 343/700 MS |
| 2011/0163934 | A1 * | 7/2011 | Tseng | 343/846 |
| 2012/0223865 | A1 * | 9/2012 | Li et al. | 343/702 |
| 2014/0009355 | A1 * | 1/2014 | Samardzija et al. | 343/789 |

FOREIGN PATENT DOCUMENTS

| | | |
|---|---|---|
| CN | 1610182 A | 4/2005 |
| CN | 102280700 | 12/2011 |
| CN | 102623801 | 8/2012 |
| TW | 555177 | 9/2003 |

* cited by examiner

*Primary Examiner* — Robert Karacsony

(74) *Attorney, Agent, or Firm* — Wei Te Chung; Ming Chieh Chang

(57) ABSTRACT

A multi-band antenna for assembling to an insulation base and metal base of an electronic device comprises: a radiating element; a first connecting element; a second connecting element; a grounding element; and a first grounding foil and a second grounding foil respectively electrically connected to the second connecting element and the grounding element along a longitudinal direction perpendicular to the transversal direction and extending to the metal base. The first grounding foil and the second grounding foil has a first part respectively extending from the second connecting and grounding element to a joint line between the insulation and the metal base and a second part attached to the metal base. A slot is formed among the first part of the first grounding foil, the first part of the second grounding foil, the second connecting element, and the joint line between the insulation base and the metal base.

10 Claims, 8 Drawing Sheets

MULTI-BAND ANTENNA

BACKGROUND OF THE INVENTION

1. Field of the Invention

The present invention relates generally to a multi-band antenna, and more particularly to a multi-band antenna used in an electronic device.

2. Description of the Prior Art

PIFA (Planar Inverted-F Antenna) is usually used in an electronic device. U.S. Pat. No. 7,136,025 discloses a multi-band antenna defining a radiating element operating at two different frequency bands, a connecting element and a grounding element. A slot is formed between the radiating element and the grounding element for adjusting an impedance of the antenna. Thus, it is difficult to reduce a distance between the radiating element and the grounding element. If the distance is decreased, as a result, the radiation effect of the antenna will be influenced. Nowadays, electronic device becomes more and more small. Therefore, the traditional PIFA can not fully meet the requirement of the miniaturization of the electronic device.

Hence, in this art, a multi-band antenna to overcome the above-mentioned disadvantages of the prior art will be described in detail in the following embodiment.

BRIEF SUMMARY OF THE INVENTION

A primary object, therefore, of the present invention is to provide a multi-band antenna occupying small space.

In order to implement the above object and overcome the above-identified deficiencies in the prior art, a multi-band antenna for assembling to an insulation base and metal base of an electronic device, the insulation base and the metal base attached with each other with a joint line formed therebetween, the multi-band antenna comprises: a radiating element; a first connecting element extending downward from one point of the radiating element; a second connecting element extending from the first connecting element along the transversal direction and paralleled with the radiating element; a grounding element spaced apart from the second connecting element and aligned with the seconding connecting element along the transversal direction; and a first grounding foil and a second grounding foil respectively electrically connected to the second connecting element and the grounding element along a longitudinal direction perpendicular to the transversal direction and extending to the metal base. And, the first grounding foil and the second grounding foil respectively has a first part respectively extending from the second connecting element and the grounding element to a joint line between the insulation base and the metal base and a second part extending from the first part and attached to the metal base, a slot is formed among the first part of the first grounding foil, the first part of the second grounding foil, the second connecting element, and the joint line between the insulation base and the metal base.

Other objects, advantages and novel features of the invention will become more apparent from the following detailed description of a preferred embodiment when taken in conjunction with the accompanying drawings.

DETAILED DESCRIPTION OF THE INVENTION

Figure 1:
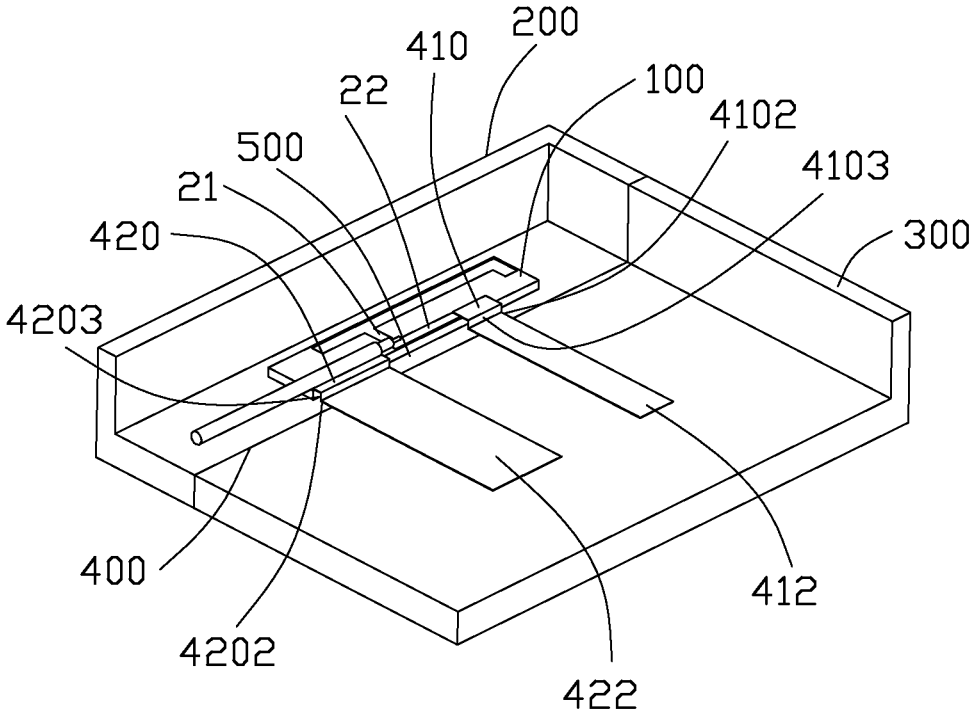
FIG. 1 is an assembled, perspective view of a multi-band antenna assembled to an insulation base and a metal base of an electronic device.
Figure 2:
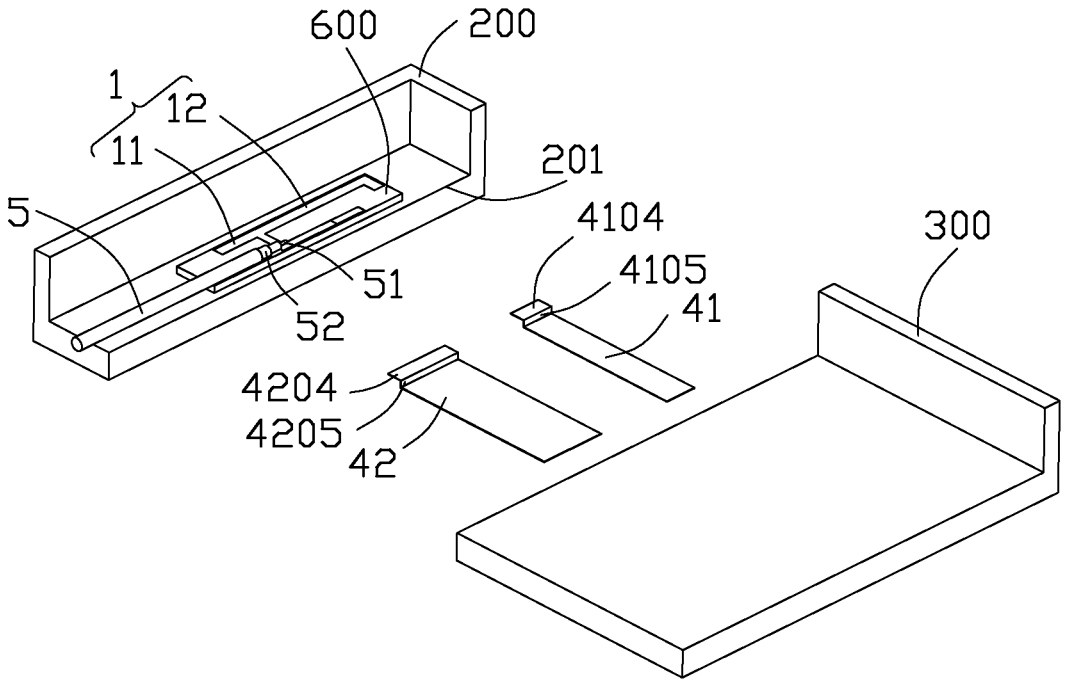
FIG. 2 is a partial exploded, perspective view of FIG. 1.
Figure 3:
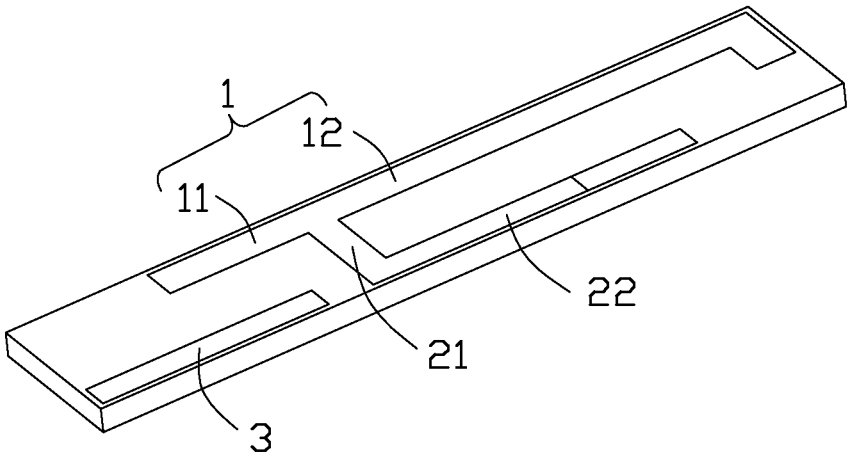
FIG. 3 is a perspective view of a part of the multi-band antenna.

Reference will now be made in detail to a preferred embodiment of the present invention.

Referring to FIGS. 1 to 7, a multi-band antenna 100 according to the preferred embodiment of the present invention for assembling to an electronic device (not figured) is a planar inverted-F antenna and comprises a radiating element 1, a first connecting element 21 extending one point of the radiating element 1 and perpendicular to the radiating element 1, a second connecting element 22 extending from the first connecting element 21 along a transversal direction and paralleled to the radiating element 1, a grounding element 3 spaced apart from the second connecting element 22 and aligned with the second connecting element 22 along the transversal direction, and a first metallic grounding foil 41 and a second metallic grounding foil 42 respectively electrically connected to the second connecting element 22 and the grounding element 3 along a longitudinal direction perpendicular to the transversal direction.

Figure 5:
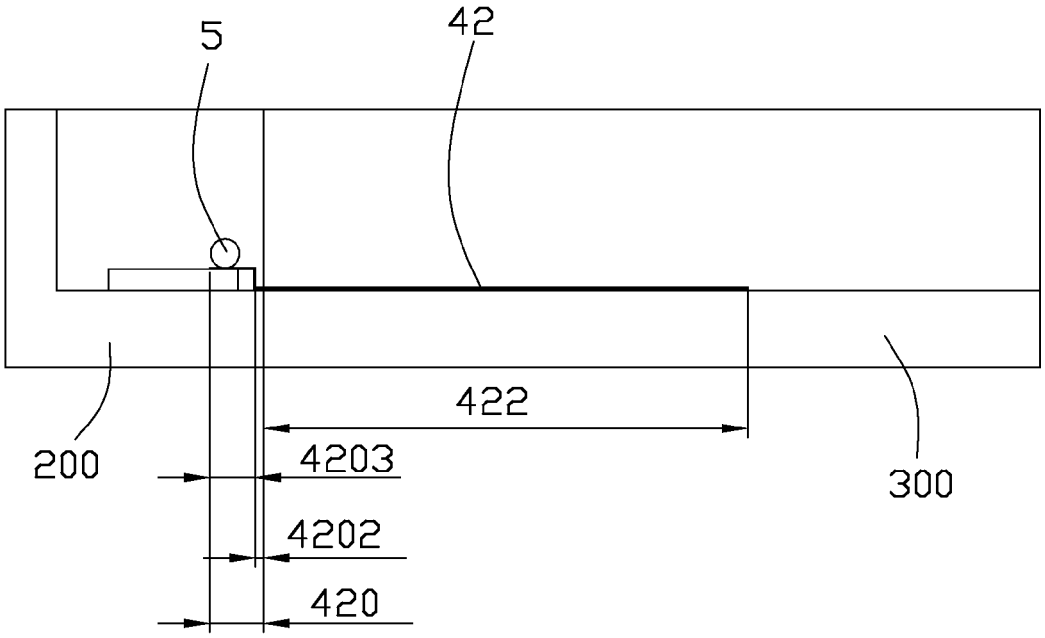
FIG. 5 is a side view of FIG. 1.
Figure 6:
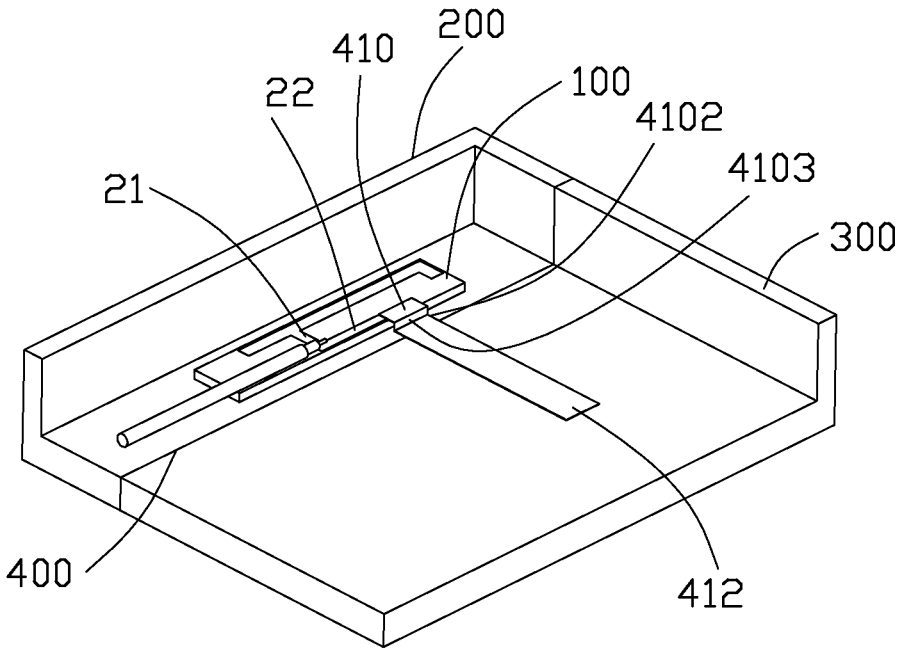
FIG. 6 is an assembled, perspective view of a portion of the multi-band antenna assembled to an insulation base and a metal base of an electronic device.
Figure 7:
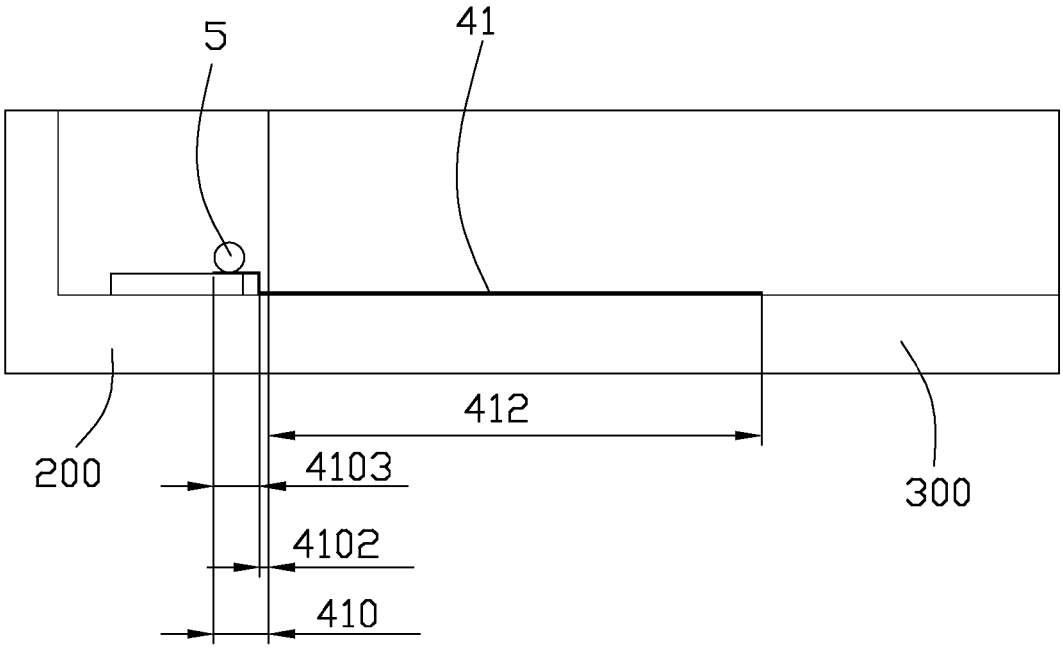
FIG. 7 is a side view of FIG. 6.

Referring to FIGS. 5 to 7, the multi-band antenna 100 is assembled to the electronic device (not shown) including an insulation or insulative base 200 and a metal or metallic base 300 attached with each other along the longitudinal or first horizontal direction. The radiating element 1 extending along a second horizontal direction perpendicular to the first horizontal direction, the first connecting element 21, the second connecting element 22 and the grounding element 3 are assembled to the insulation base 200. The first connecting element 21 connected to the radiating element 1 and extending along the first horizontal direction, and the second connecting element 22 connected to an end of the first connecting element 21 and extending along the second horizontal direction, commonly define an L-shaped configuration to be a connecting element assembly. The grounding element 3 extends along the second horizontal direction while being spaced from the L-shaped connecting element in the second horizontal direction. The first grounding foil 41 and the second grounding foil 42 respectively has a first part 410, 420 extending from the second connecting element 22 and the grounding element 3 to a joint line 400 between the insulation base 200 and the metal base 300 and a second part 412, 422 extending from the first part 410, 420 and attached to the metal base 300. In other words, the first grounding foil 41 is connected with an between the second connecting element 22 and the metallic base 300 while the second grounding foil 42 is connected with and between the grounding element 3 and the metallic base 300 wherein both the first grounding foil 41 and the second grounding foil 42 extend along the first horizontal direction. A slot 500 is formed among the first part 410 of the first grounding foil 41, the first part 420 of the second grounding foil 42, the second connecting element 22, and the joint line 400 between the insulation base 200 and the metal base 300.

Figure 8:
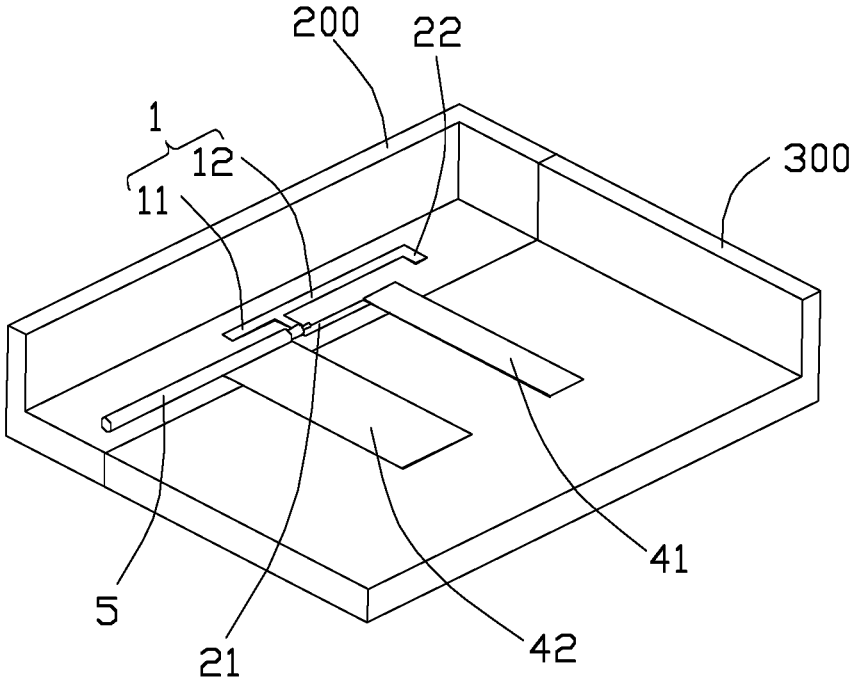
FIG. 8 is an assembled, perspective view of a multi-band antenna assembled to an insulation base and a metal base of an electronic device according to another embodiment of the invention.

In the preferred embodiment of the present invention, the multi-band antenna 100 further comprises an insulation body 600 assembled to the insulation base 200. The radiating element 1, the first connecting element 21, the second connecting element 22 and the grounding element 3 are formed on the insulation body 600 by etching or other methods. In other embodiment of the present invention as shown in FIG. 8, all of the radiating element 1, a first connecting element 21, the second connecting element 22 and the grounding element 3 can be made from a metal sheet and then directly assembled to insulation base 200.

Referring to FIGS. 5 to 7, the first grounding foil 41 and the second grounding foil 42 respectively extends from the second connecting element 22 and the grounding element 3 to metal base 300. Each of the first part 410, 420 comprises a first section 4102, 4202 attached to the insulation base 200 and a second section 4103, 4203 respectively extending upwardly and rearward from the first section 4102, 4202. The second section 4103, 4203 is structured in a L-shape and respectively comprises a horizontal segment 4104, 4204 paralleled to the insulation body 600 and a vertical segment 4105, 4205. The first grounding foil 41 and the second grounding foil 42 are respectively structured in a Z-shape when the first and second grounding foil are viewed from left side. In the preferred embodiment of the present invention, a width of the first grounding foil 41 is smaller than the width of the second grounding foil 42. In other embodiments of the present invention, the width of the first grounding foil 41 and the second grounding foil 42 can be adjusted according to requirement.

The radiating element 1, a first connecting element 21, the second connecting element 22 and the grounding element 3 are formed on the same plane. The radiation element 1 comprises a first radiation portion 11 extending leftwards from a end of the first connecting element 21 and a second radiation portion 12 extending rightwards from the end of the first connecting element 21. The second radiation portion 12 is structured in a L-shape. The first radiation portion 11 and the second radiation portion 12 are respectively operated at different frequency bands.

The multi-band antenna 100 further comprises a feeding or feeder cable 5 having an inner conductor 51 connecting with a joint of the first connecting element 21 and the second connecting element 22 and an outer conductor 52 soldering to the grounding element 3.

Figure 4:
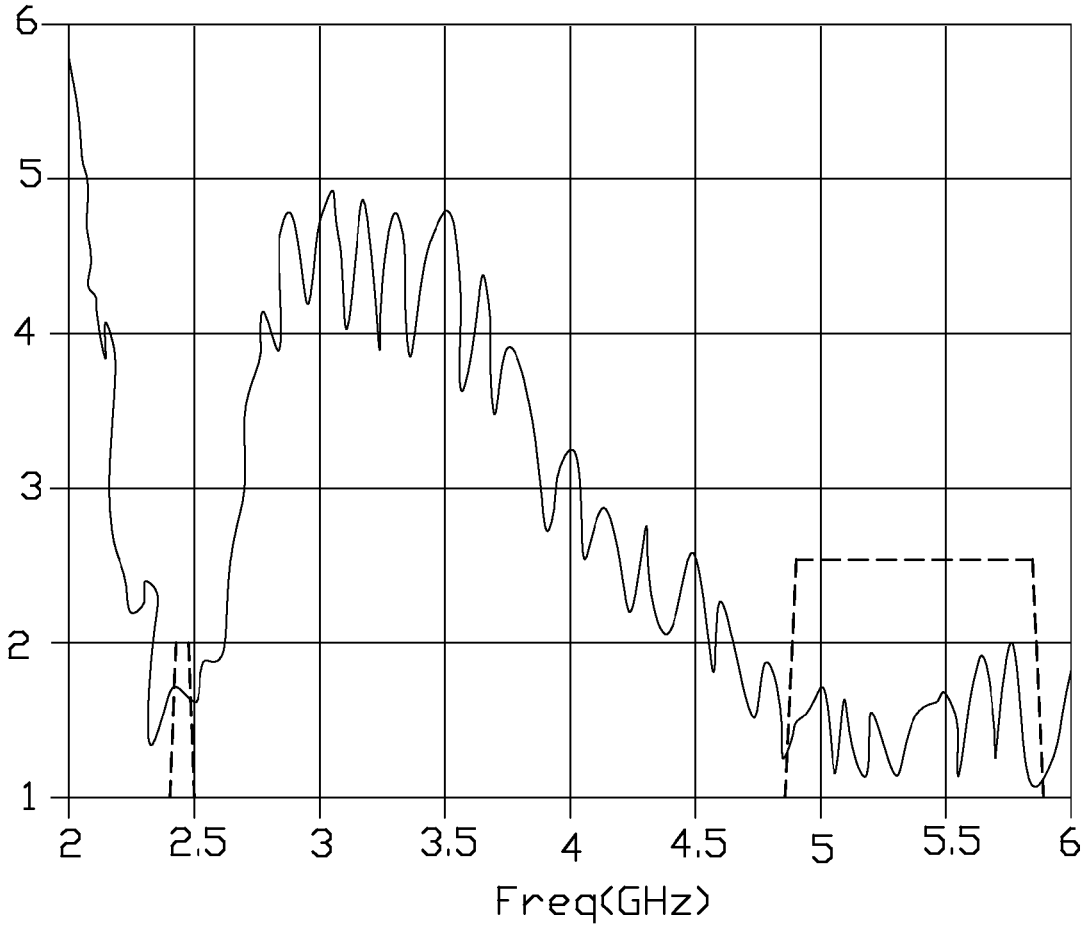
FIG. 4 is a test chart recording of Voltage Standing Wave Ratio (VSWR) of the multi-band antenna as a function of frequency.

In the preferred embodiment of the present invention, the first and second grounding foil 41, 42 of the antenna 100, the insulation base 200 and the metal base 300 are well used and assembled with each other in a reasonable arrangement to form a slot 500 to adjust the impedance matching of the multi-band antenna 100. Thus, there is no need to form two or more slots formed between the second connecting element 22 and the grounding element 3 directly extending from the second connecting element 22 and paralleled with each other in the prior art. And, in the present invention, the grounding element 3 can be designed in a small size. And the first grounding foil 41 and the second grounding foil 42 will not occupy more room due to the first and second foils 41, 42 directly attached to the insulation base 200 and the metal base 300. Thus, the manufacturing cost of the multi-band antenna 100 is reduced and the multi-band antenna 100 is small and will not occupy more room. Referring to FIG. 4, the multi-band antenna 100 can operate at a higher frequency band and a lower frequency band. In other embodiment of the present invention, the structure and the width of the first part 410, 420 can be adjusted to form a slot 500 according to requirement for impedance matching. In the preferred embodiment of the present invention, the first grounding foil 41 and the second grounding foil 42 respectively connects with the second connecting element 22 and a grounding element 3. In other embodiment of the present invention, the distance between the first grounding foil 41 and the second grounding foil 42 can also be adjusted.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A multi-band antenna for assembling to an insulation base and metal base of an electronic device, the insulation base and the metal base attached with each other with a joint line formed therebetween, the multi-band antenna comprising:

a radiating element;

a first connecting element extending downward from one point of the radiating element;

a second connecting element extending from the first connecting element along the transversal direction and paralleled with the radiating element;

a grounding element spaced apart from the second connecting element and aligned with the seconding connecting element along the transversal direction; and a first grounding foil and a second grounding foil respectively electrically connected to the second connecting element and the grounding element along a longitudinal direction perpendicular to the transversal direction and extending to the metal base; wherein the first grounding foil and the second grounding foil respectively has a first part respectively extending from the second connecting element and the grounding element to a joint line between the insulation base and the metal base and a second part extending from the first part and attached to the metal base, a slot is formed among the first part of the first grounding foil, the first part of the second grounding foil, the second connecting element, and the joint line between the insulation base and the metal base.

2. The multi-band antenna as claimed in claim 1, wherein the multi-band antenna further comprises an insulation body assembled to the insulation base, the radiating element, the first connecting element, the second connecting element and the grounding element are formed on insulation body through etching method.

3. The multi-band antenna as claimed in claim 2, wherein each of the first part of the first grounding foil and the second grounding foil respectively comprises a first section attached to the insulation base and a second section respectively extending rearward from the first section and electrically connected to the second connecting element and the grounding element.

4. The multi-band antenna as claimed in claim 3, wherein each of the second section of first part is structured in a L-shape and comprises a horizontal segment paralleled to the insulation body and a vertical segment connecting the horizontal section to the corresponding first section of first part.

5. The multi-band antenna as claimed in claim 2, wherein the radiating element, a first connecting element, the second connecting element and the grounding element are formed on a same plane.

6. The multi-band antenna as claimed in claim 1, wherein the radiation element comprises a first radiation portion extending from a end of the first connecting element along a leftwards direction and a second radiation portion extending from the end of the first connecting element along a rightwards direction.

7. The multi-band antenna as claimed in claim 6, wherein the second radiation portion is structured in a L-shape.

8. The multi-band antenna as claimed in claim 7, wherein the first radiation portion and the second radiation portion are respectively operated at two different frequency bands.

9. The multi-band antenna as claimed in claim 1, wherein the first grounding foil and the second grounding foil are structured in a Z-shape when the first and second grounding foil viewed from leftside.

10. The multi-band antenna as claimed in claim 1, wherein the multi-band antenna further comprises a feeding cable defining an inner conductor connecting with a joint of the first connecting element and the second connecting element and an outer conductor soldering to the grounding element.

* * * * *